US011587500B2

(12) United States Patent
Sun et al.

(10) Patent No.: US 11,587,500 B2
(45) Date of Patent: Feb. 21, 2023

(54) DATA DISPLAY METHOD AND DEVICE, AND READABLE STORAGE MEDIUM

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Binhua Sun, Beijing (CN); Feng Zi, Beijing (CN); Jiyang Shao, Beijing (CN); Feng Gao, Beijing (CN)

(73) Assignees: BEIJING BOE OPTOELECTRONICS TECHNOLOGY CO., LTD., Beijing (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/353,469

(22) Filed: Jun. 21, 2021

(65) Prior Publication Data

US 2022/0208077 A1 Jun. 30, 2022

(30) Foreign Application Priority Data

Dec. 25, 2020 (CN) ..... 202011562777.9

(51) Int. Cl.
*G09G 3/32* (2016.01)
*G09G 3/20* (2006.01)

(52) U.S. Cl.
CPC ..... *G09G 3/32* (2013.01); *G09G 3/2096* (2013.01); *G09G 2320/0626* (2013.01); *G09G 2340/0407* (2013.01); *G09G 2360/121* (2013.01)

(58) Field of Classification Search
CPC ..... G09G 3/32; G09G 3/2096; G09G 2320/0626; G09G 2340/0407; G09G 2360/121
See application file for complete search history.

(56) References Cited

U.S. PATENT DOCUMENTS

2008/0030453 A1* 2/2008 Chen ..... G09G 3/3685 345/98
2013/0300773 A1* 11/2013 Kim ..... G09G 5/10 345/690

(Continued)

FOREIGN PATENT DOCUMENTS

CN 101404135 A 4/2009
CN 202694758 U 1/2013

(Continued)

OTHER PUBLICATIONS

First Office Action in the Chinese Patent Application No. 202011562777.9 dated Sep. 24, 2021; English translation attached.

*Primary Examiner* — Michael A Faragalla
*Assistant Examiner* — Sujit Shah
(74) *Attorney, Agent, or Firm* — Intellectual Valley Law, P.C.

(57) ABSTRACT

A data display method and device based on an ARM micro-controller, and a readable storage medium are provided. The data display method includes receiving data signals of a display image, and storing the data signals; extending the stored data signals into multiple data signal sets in a preset sequence, and synchronously caching the multiple data signal sets in a rising edge and a falling edge of a clock signal; and controlling the multiple data signal sets to be respectively output to multiple output ports to control a display unit to display the image.

14 Claims, 8 Drawing Sheets

(56) References Cited

U.S. PATENT DOCUMENTS

| | | | | |
|---|---|---|---|---|
| 2016/0042718 | A1* | 2/2016 | Su | G09G 3/006 345/589 |
| 2017/0300195 | A1* | 10/2017 | Kim | H04N 21/4312 |
| 2019/0303314 | A1 | 10/2019 | Li et al. | |
| 2020/0312228 | A1* | 10/2020 | Lee | G09G 3/32 |
| 2021/0035518 | A1* | 2/2021 | Yabuki | G09G 3/3688 |

FOREIGN PATENT DOCUMENTS

| | | | |
|---|---|---|---|
| CN | 103310735 | A | 9/2013 |
| CN | 104505018 | A | 4/2015 |
| CN | 105301368 | A | 2/2016 |
| CN | 108228493 | A | 6/2018 |

* cited by examiner

DATA DISPLAY METHOD AND DEVICE, AND READABLE STORAGE MEDIUM

CROSS REFERENCE TO RELEVANT DISCLOSURES

The application claims priority to Chinese Patent Application No. 202011562777.9, filed on Dec. 25, 2020, the contents of which are incorporated herein by reference in its entirety.

TECHNICAL FIELD

The disclosure relates to the technical field of display, in particular to a data display method and device, and a readable storage medium.

BACKGROUND

At present, mini light emitting diodes (mini LEDs), mainly applied to the fields of direct backlight and RGB display, are developing vigorously and have become an irresistible tread in the display industry because of their technical advantages of high dynamic contrast, high resolution, and high-brightness display. ARM micro-controllers have been widely used on account of their advantages of low power consumption, low cost, high performance, flexible operation, and the like.

SUMMARY

The embodiments of the disclosure provide a data display method and device, and a readable storage medium.

The embodiments of the disclosure provide a data display method based on an ARM micro-controller, being applied to a mini-LED display device, and comprising:

receiving data signals of a display image, and storing the data signals;

extending the stored data signals into multiple data signal sets in a preset sequence, and synchronously caching the multiple data signal sets in a rising edge and a falling edge of a clock signal; and controlling the multiple data signal sets to be respectively output to multiple output ports to control a display unit to display the image.

In some embodiments, the data display method further comprising acquiring a chip select signal.

In some embodiments, wherein the step of extending the stored data signals into multiple data signal sets in a preset sequence, and synchronously caching the multiple data signal sets in a rising edge and a falling edge of a clock signal comprises:

controlling, when the chip select signal is pulled down and the clock signal outputs a signal at a preset clock time, the data signals in the multiple data signal sets to be cached in the rising edge and the falling edge of the clock signal.

In some embodiments, wherein the multiple output ports correspond to multiple display blocks of the display unit, and the step of controlling the multiple data signal sets to be respectively output to multiple output ports to control a display unit to display the image comprises:

correspondingly transmitting the multiple data signal sets to the multiple display blocks.

In some embodiments, wherein the step of controlling the multiple data signal sets to be respectively output to multiple output ports to control a display unit to display the image comprises:

starting a timer of the clock signal, and setting an initial value in the timer;

repeating, wherein the data signal has not been transmitted, performing the following steps:

outputting, when it is determined that count values of the timer are greater than or equal to half of the initial value, four high bits in one byte of a data signal in a buffer;

controlling, when the timer is interrupted, a level of the clock signal to be inverted, and resetting the initial value of the timer;

outputting, when it is determined that count values of the timer are greater than or equal to half of the initial value, four low bits in one byte of the data signal in the buffer;

controlling, when the timer is interrupted, the level of the clock signal to be inverted, and resetting the initial value of the timer; and end repeating, turning off the timer of the clock signal when the data signal has been transmitted.

In some embodiments, wherein a timing frequency of the timer depends on the initial value.

In some embodiments, the data display method further comprising:

transmitting the multiple data signal sets by means of an image interface protocol to control the display unit to display the image, wherein the image interface protocol includes a control data protocol and an image data protocol.

In some embodiments, the data display method further comprising:

controlling at least one of the resolutions, refresh rate and display brightness of the display unit according to the control data protocol.

In some embodiments, the data display method further comprising controlling the image to be displayed according to the image data protocol.

In some embodiments, the data display method further comprising:

controlling the image to be displayed according to the image data protocol.

In some embodiments, the control data protocol may include address, functional instruction, instruction parameter and check bit, the image data protocol may include address, image data and check bit.

The embodiments of the disclosure also provide a data display device based on an ARM micro-controller, comprising: an ARM system unit and a display unit, wherein the ARM system unit comprises a data receiving unit, a processing system unit, a data cache unit, a data storage unit and a data transmission unit;

the processing system unit is used for:

controlling the data receiving unit to receive data signals of a display image, and controlling the data storage unit to store the data signals;

controlling the data cache unit to extend the stored data signals into multiple data signal sets in a preset sequence and synchronously cache the multiple data signal sets in a rising edge and a falling edge of a clock signal; and controlling the data transmission unit to output the multiple data signal sets to multiple output ports respectively to control the display unit to display the image.

In some embodiments, wherein the display unit comprises a drive unit and an LED display panel.

In some embodiments, the drive unit is used for driving the display unit to start to receive data signals and display an image according to the data signals, the LED display panel is used for displaying the image.

In some embodiments, the data display device further comprising display device ports respectively corresponding to multiple display blocks, and the multiple display blocks are used for displaying the image according to the multiple data signal sets.

In some embodiments, the data display device further comprising a field debugging unit and a remote-control unit, wherein the field debugging unit is used for debugging a configuration of the display device; and the remote-control unit is used for wirelessly controlling remote on-off and function switching of the ARM system unit and the display unit.

The disclosure also provides an electronic device, wherein the electronic device comprises:

a memory configured for storing a computer instruction executable by the processor; and one or more processors, wherein the processors are configured for executing the computer instruction, to implement the above data display method.

The disclosure also provides a computer program product with the computer readable code, wherein when an instruction in the computer program product is executed by a processor of an electronic device, the instruction enables the electronic device to implement the above data display method.

The disclosure also provides a non-transient computer storage medium, wherein when an instruction in the storage medium is executed by a processor of an electronic device, the instruction enables the electronic device to implement the above data display method.

Other aspects and advantages of the disclosure will be given in the following description, and part of these aspects and advantages of the disclosure will become obvious in the following description, or be known in the practice of the disclosure.

BRIEF DESCRIPTION OF THE DRAWINGS

To more clearly explain the technical solutions of the embodiments of the disclosure or related arts, drawings required for describing the embodiments of the disclosure or the related arts will be briefly introduced below. Obviously, the drawings in the following description only illustrate some embodiments of the invention, and those ordinarily skilled in the art can obtain other drawings according to the following ones without creative labor.

The embodiments of the disclosure will be described below in conjunction with the following drawings to make the above and/or other aspects and advantages of the disclosure obvious and easily understood. Wherein.

DETAILED DESCRIPTION

Figure 1:
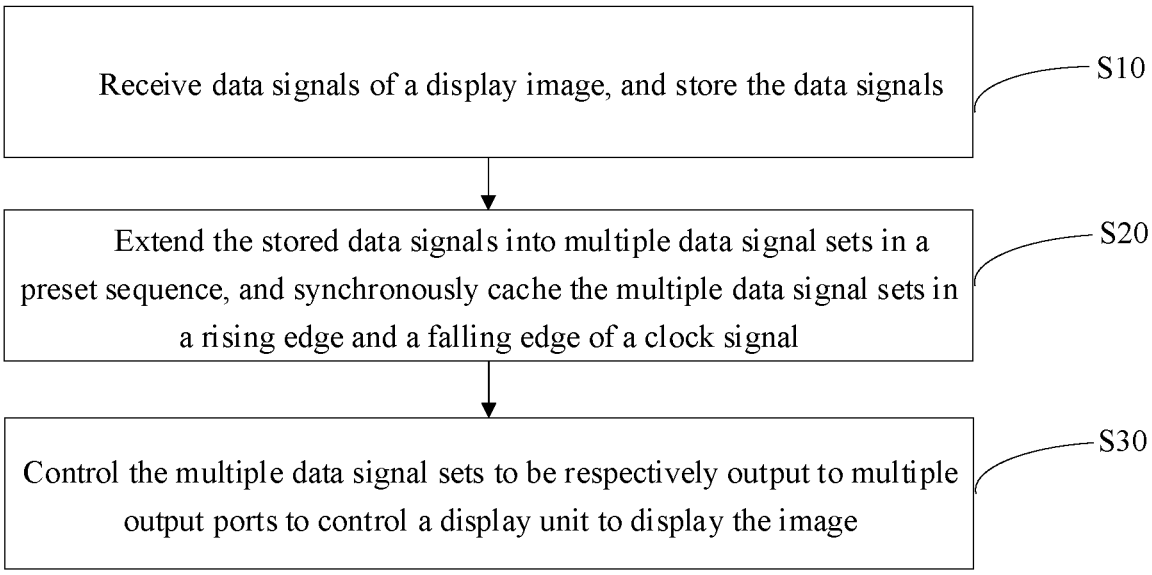
FIG. 1 is a flow diagram of a data display method according to one embodiment of the disclosure.

To gain a better understanding of the above purposes, features and advantages of the disclosure, the disclosure will be described in further detail below in conjunction with the accompanying drawings and specific implementations. Obviously, the embodiments in the following description are merely illustrative ones, and are not all possible ones of the disclosure. All other embodiments obtained by those ordinarily skilled in the art based on the following ones without creative labor should also fall within the protection scope of the disclosure.

The embodiments of the disclosure will be described in detail below, and examples of the embodiments are illustrated by the accompanying drawings, in which identical or similar reference signs represent identical or similar elements, or elements with identical or similar functions throughout the specification. The embodiments described below with reference to the accompanying drawings are illustrative ones merely for explaining the disclosure, and should not be construed as limitations of the disclosure.

It should be understood that terms such as "central", "lengthwise", "crosswise", "length", "width", "thickness", "upper", "lower", "front", "back", "left", "right", "vertical", "horizontal", "top", "bottom", "inner", "outer", "clockwise" and "anticlockwise" in the description of the invention are used to indicate directional or positional relations based on the accompanying drawings merely for the purpose of facilitating and simplifying the description of the disclosure, do not indicate or imply that devices or elements referred to must be in a specific direction, or be configured and operated in a specific direction, and thus, should not be construed as limitations of the disclosure. In addition, terms "first" and "second" are merely for the purpose of description, and should not be construed as indicating or implying relative importance or implicitly indicating the number of technical features referred to. So, a feature defined by "first" or "second" may explicitly or implicitly indicate the inclusion of one or more said feature. Unless otherwise specifically defined, "multiple" in the description of the disclosure refers to two or more.

It should be noted that, unless otherwise clearly specified and defined, terms such as "install", "connect" and "connection" in the description of the invention should be broadly understood. For example, "connection" may refer to fixed connection, detachable connection or integrated connection, or mechanical connection, electrical connection or mutual communication, or direct connection or indirect connection via an intermediate medium, or internal communication or interaction of two elements. Those ordinarily skilled in the art may appreciate the specific meanings of these terms in the disclosure as the case may be.

In the disclosure, unless otherwise clearly specified and defined, if a first feature is located "over" or "under" a second feature, the first feature directly contacts with the second feature, or the first feature contacts with the second feature by means of another feature between the first feature and the second feature rather than directly contacting with the second feature. In addition, when the first feature is located "above" the second feature, the first feature may be located exactly above the second feature or be located above the second feature obliquely, or the level of the first feature is greater than that of the second feature. When the feature is located "below" the second feature, the first feature may be located exactly below the second feature or be located below the second feature obliquely, or the level of the first feature is smaller than that of the second feature.

Many different embodiments or examples are provided below to implement different structures of the disclosure. To simplify the description of the disclosure, components and settings of specific examples are described below merely for illustration, and are not intended to limit the disclosure. In addition, reference figures and/or letters are repeated in different examples of the disclosure for the purpose of simplification and clarity, and do not indicate any relation between different embodiments and/or setting discussed. Besides, the disclosure provides examples of different specific processes and materials are provided, but those ordinarily skilled in the art would appreciate that other processes may be applied and/or other materials may be used.

At present, mini LEDs, mainly applied to the fields of direct backlight and RGB display, are developing vigorously and have become an irresistible tread in the display industry because of their technical advantages of high dynamic contrast, high resolution, high-brightness display. The direct backlight has a large spacing, a small number of partitions, and simple drive control. RGB display has a small spacing and a high resolution, but it has higher requirements for high-speed data transmission. To meet system drive control requirements, most systems adopt an FGPA solution, which is high in cost and power consumption and thus unable to meet the requirements of portable display devices. ARM micro-controllers have been widely used on account of their advantages of low power consumption, low cost, high performance, flexible operation, and the like. However, standard peripheral ports of the ARM micro-controllers, such as SPI ports and USART ports, are unable to meet the requirements for data sizes in the display industry, and high-speed ports of the ARM micro-controllers, such as TLI ports, are complicated in disclosure and difficult to operate.

In view of this, referring to FIG. 1, the disclosure provides a data display method based on an ARM micro-controller, which is applied to a mini-LED display device and comprises:

S10: receiving data signals of a display image, and storing the data signals;

S20: extending the stored data signals into multiple data signal sets in a preset sequence, and synchronously caching the multiple data signal sets in a rising edge and a falling edge of a clock signal; and S30: controlling the multiple data signal sets to be respectively output to multiple output ports to control a display unit to display the image.

Specifically, the data signals (SDA) refer to signals representing data information of the display image, wherein the data information of the display image includes pixels, brightness and color temperature of the image. The clock signal (CLK), as a term in computer science and relevant fields, is generally used in a synchronous circuit to serve as a timer to guarantee synchronous operation of relevant electronic components. The clock signal CLK is mapped to a port with a pulse width modulation (PWM) output multiplexing function of the timer.

Figure 2:
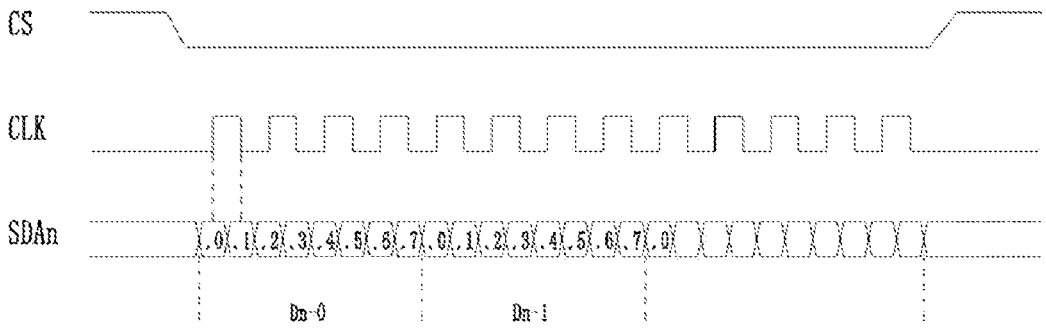
FIG. 2 is a scenario diagram of the data display method according to one embodiment of the disclosure.

First of all, a data receiving unit 10 in an ARM system unit 100 receives data signals (SDA) of a display image from a field debugging unit 300. Then, the stored data signals are extended into multiple data signal sets in a preset sequence and are synchronously cached in a rising edge and a falling edge of a clock signal (CKL), so that the size of cached data is increased twice in the same cache time, thus greatly increasing the data cache rate. Wherein, the rising edge of the clock signal (CLK) refers to a rising process of from a low level to a high level, as shown in FIG. 2; and the falling edge of the clock signal (CLK) refers to a falling process of from a high level to a low level, as shown in FIG. 2. The number of the multiple data signal sets may be two or more. In one embodiment of the disclosure, four data signal sets are described by way of example, and the four data signal sets (also referred to as data lines) are SDA0, SDA1, SDA2 and SDA3, respectively.

Figure 3:
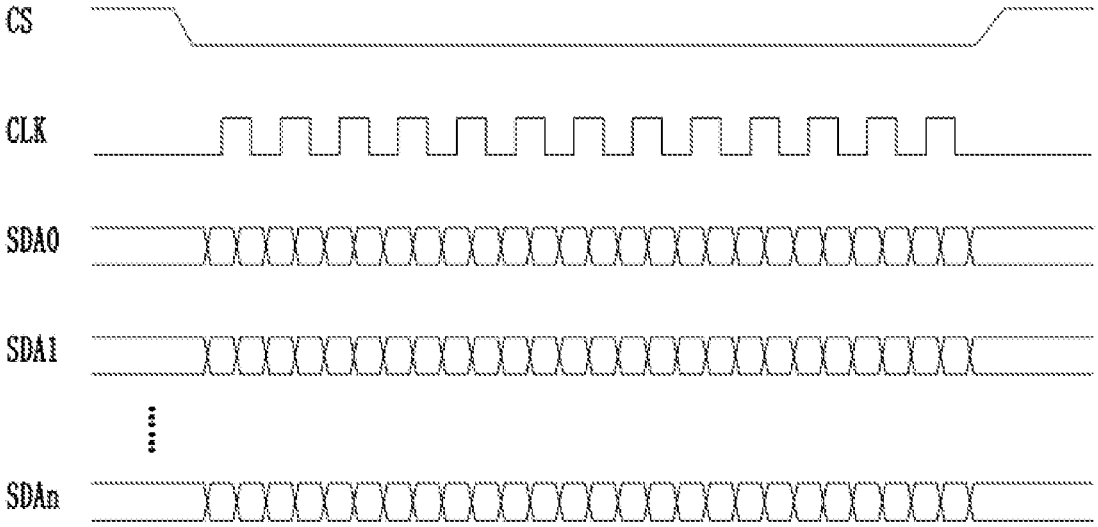
FIG. 3 is a scenario diagram of the data display method according to one embodiment of the disclosure.
Figure 4:
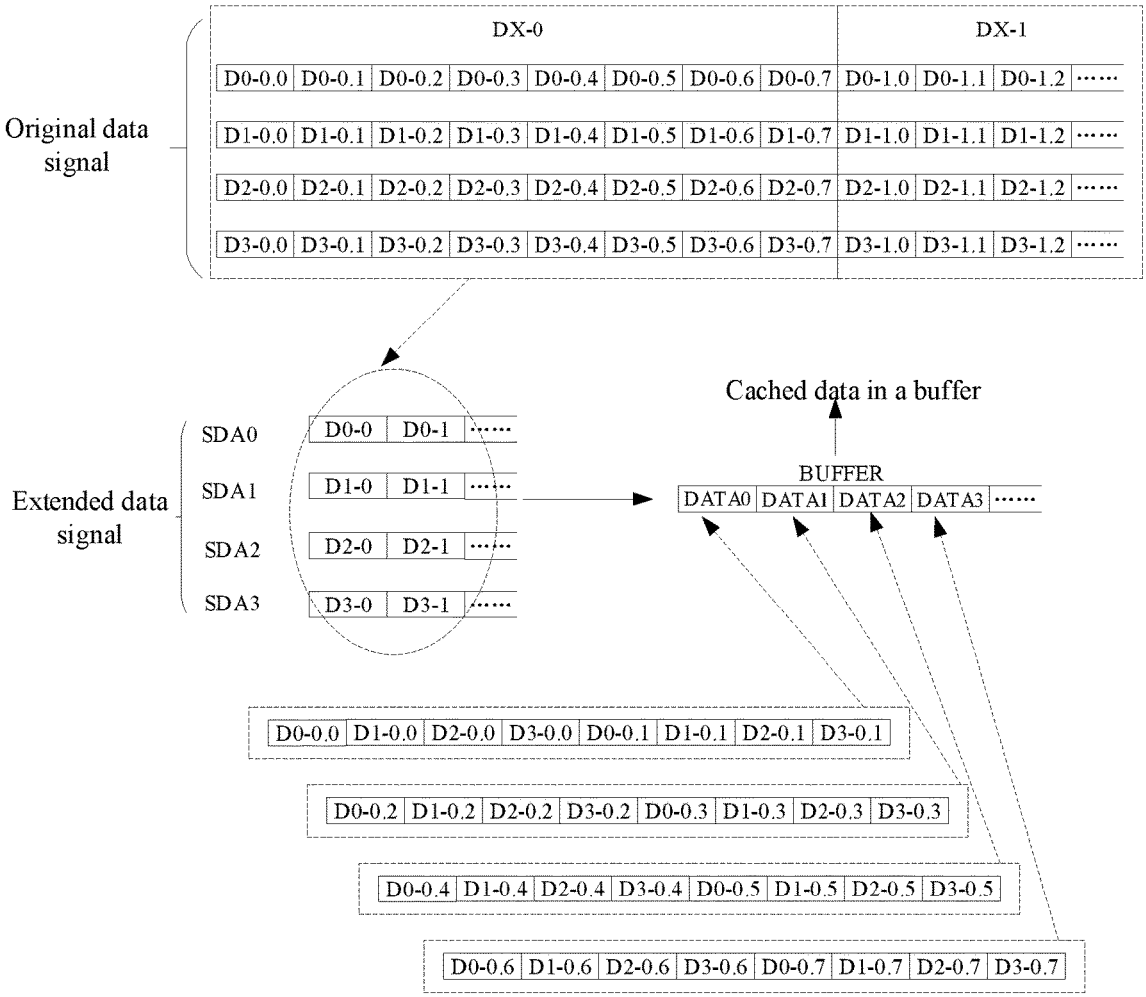
FIG. 4 is a scenario diagram of the data display method according to one embodiment of the disclosure.

Specifically, referring to FIG. 3, the preset sequence refers to a sequence in which data signals in SDAn are extended into n data signal sets, as shown in FIG. 3. For example, in one embodiment of the disclosure, as shown in FIG. 4, the four data signal sets are SDA0, SDA1, SDA2 and SDA3 respectively, and SDA0, SDA1, SDA2 and SDA3 may be aligned. Multiple data signal sets are synchronously cached in the rising edge and the falling edge of the clock signal to accelerate cache, so that the cache efficiency is improved.

Referring to FIG. 4, Dn-m.x in FIG. 4 represent upper byte data of the data signals SDA in a data storage unit 20, wherein n is a natural number less than 16 and corresponds to the data lines SDA0, SDA1, SDA2 and SDA3; m is the size of upper byte data of the data lines; x is a corresponding bit number in the byte data and is a natural number less than 8. It may be understood that, referring to FIG. 4, SDA0, SDA1, SDA2 and SDA3 are sequentially arrayed in four rows and data stored in the four rows are aligned in sequence, so data in columns are sequentially acquired in a vertical scanning direction according to the bit numbers in Dn-m.x to constitute DATA. As shown in FIG. 4, four pieces of data (D0-0.0, D1-0.0, D2-0.0, D3-0.0) in the first column of Dn-m.x and four pieces of data (D0-0.1, D1-0.1, D2-0.1, D3-0.1) in the second column of Dn-m.xconstituteDATA0. Four pieces of data (D0-0.2, D1-0.2, D2-0.2, D3-0.2) in the third column of Dn-m.x and four pieces of data (D0-0.3, D1-0.3, D2-0.3, D3-0.3) in the fourth column of Dn-m.x-constituteDATA1. Four pieces of data (D0-0.4, D1-0.4, D2-0.4, D3-0.4) in the fifth column of Dn-m.x and four pieces of data (D0-0.5, D1-0.5, D2-0.5, D3-0.5) in the sixth column of Dn-m.xconstituteDATA2. Four pieces of data (D0-0.6, D1-0.6, D2-0.6, D3-0.6) in the seventh column of Dn-m.x and four pieces of data (D0-0.7, D1-0.7, D2-0.7, D3-0.7) in the eighth column of Dn-m.x constituteDATA3. By analogy, the data signals SDA are cached. DATA (including DATA0, DATA1, DATA2, DATA3, . . . ) is cached data.

It may be understood that TATA is cached data, which is recoded to adapt to data operations of PORT of the ARM micro-controller, in a data cache unit, and the size of the cached data is M*4 bytes.

The multiple output ports refer to output ports PORTx.n, corresponding to the multiple data signal sets SDAn (n is a natural number less than 16), of the ARM micro-controller, wherein x may be A, B, C, D, or the like, and n is a natural number less than 16. Specifically, according to the data display method provided by the disclosure, bytes are controlled by a program to be written into PORTx to output multiple data signals SDAn (n is a natural number less than 16), and the data signal SDAn (n is a natural number less than 16) is correspondingly output to PORTx.n (x is a natural number less than 8, and n is a natural number less than 16).

It may be understood that the data signals SDA correspond to the output ports PORTx of the ARM microcontroller, and bytes are written into PORTx by software to output the data signals, wherein x may be A, B, C, D, or the like, and the data signals SDAn are correspondingly output to the output ports PORTx.n, namely ports PORTx.

In some embodiments, the data display method further comprises acquiring a chip select signal CS, wherein the chip select signal CS is mapped to a common hardware port.

In some embodiments, more specifically, the step of extending the stored data signals into multiple data signal sets in a preset sequence, and synchronously caching the multiple data signal sets in a rising edge and a falling edge of a clock signal (S20) comprises: controlling the data signals in the multiple data signal sets SDAn to be cached in the rising edge and the falling edge of the clock signal CLK when the chip select signal CS is pulled down and the clock signal CLK outputs a signal at a preset clock time. In this way, the cache is accelerated, and the cache efficiency is improved.

Specifically, in a specific embodiment, a display unit enters a data receiving state when the chip select signal CS is pulled down; then, a clock timer CLK1 in the clock signal CLK is started, an initial value K is set in the clock timer CLK1, and by changing the parameter value of K, the clock frequency of the clock signal CLK may be adjusted, and the clock time of the clock time may also be adjusted. The initial value K is the preset clock time. For example, the initial value K may by 1 μs, 2 μs, 3 μs, 4 μs, 5 μs, or the like, and the disclosure has no limitation in this aspect. The initial value K may be set to different values according to cache rates required by users. It may be understood that when a high cache rate is required by users, the initial value K may be set to a high value such as 5 μs; and when a low cache rate is required by users, the initial value K may be set to a low value such as 1 μs. The disclosure has no limitation in this aspect.

When the chip select signal CS is pulled down and the clock signal CLK outputs a signal at the preset clock time, the data signals in the multiple data signal sets are controlled by a program, pre-written by users, to be cached synchronously in the rising edge and the falling edge of the clock signal CLK, so that the cache is accelerated, and the cache efficiency is improved.

Figure 5:
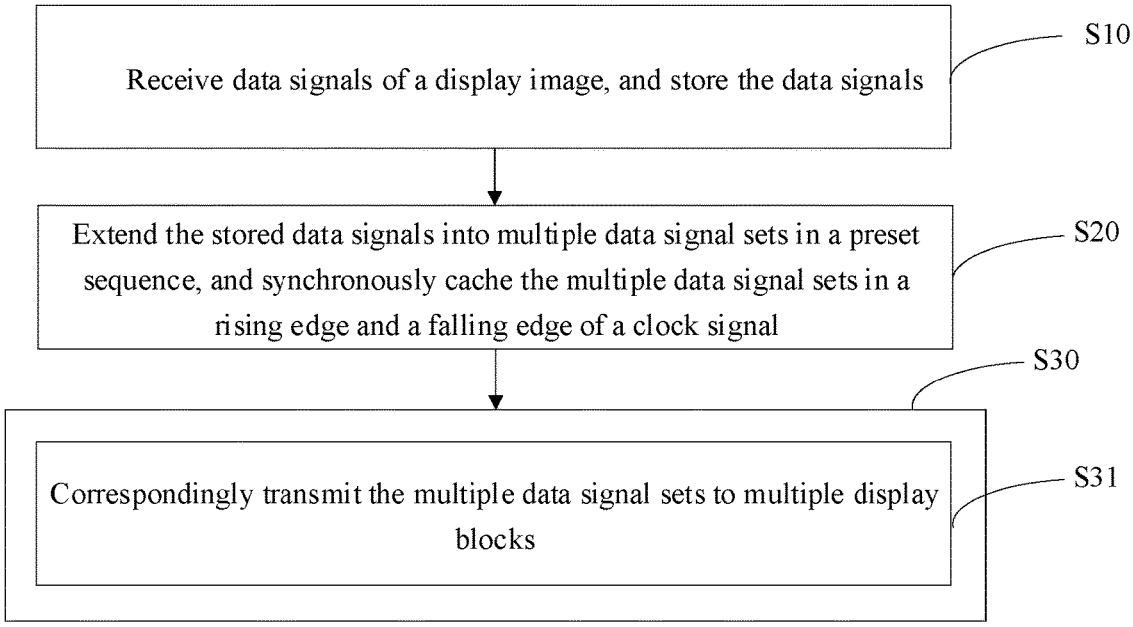
FIG. 5 is a flow diagram of the data display method according to one embodiment of the disclosure.

In some embodiments, the multiple output ports PORTx.n correspond to multiple display blocks Block (n+1) of the display unit, wherein n is a natural number less than 16. Referring to FIG. 5, the step of controlling the multiple data signal sets SDAn to be respectively output to the multiple output ports PORTx.n to control the display unit to display the image (S30) comprises:

S31: correspondingly transmitting the multiple data signal sets SDAn to the multiple display blocks Block (n+1).

Figure 6:
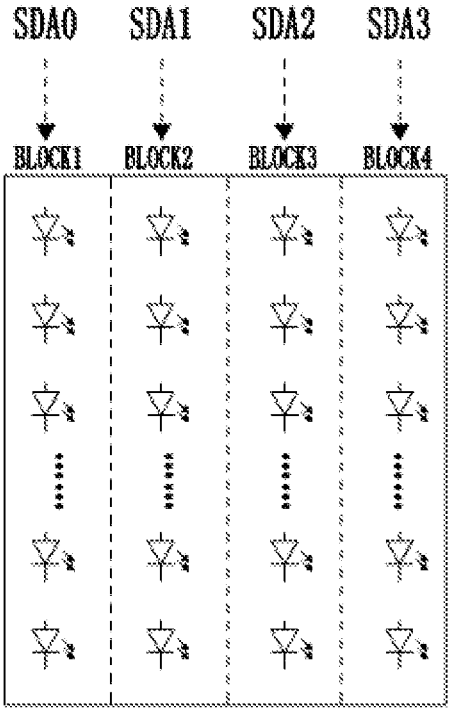
FIG. 6 is a flow diagram of the data display method according to one embodiment of the disclosure.

It may be understood that, as shown in FIG. 6, the multiple output ports PORTx.n are multiple output ports disposed on the ARM system unit 100. The multiple display blocks Block (n+1) are (n+1) blocks obtained by averagely dividing an image display area of the display unit, wherein n is a natural number less than 16. The multiple output ports PORTx.n correspond to the multiple display blocks Block (n+1) of the display unit, so that image data may be synchronously output to the display unit via the multiple ports PORTx.n, thus increasing the transmission rate of the image data.

Specifically, the multiple data signal sets SDAn are correspondingly transmitted to the multiple display blocks Block (n+1). For example, when n is equal to 3 (as shown in FIG. 6), the multiple data signal sets SDAn are SDA0, SDA1, SDA2 and SDA3, and the multiple corresponding display blocks Block (n+1) are Block1, Block2, Block3 and Block4 respectively, wherein data in SDA0 is correspondingly output to Block 1, data in SDA1 is correspondingly output to Block 2, data in SDA3 is correspondingly output to Block 3, and data in SDA3 is correspondingly output to Block4.

Figure 7:
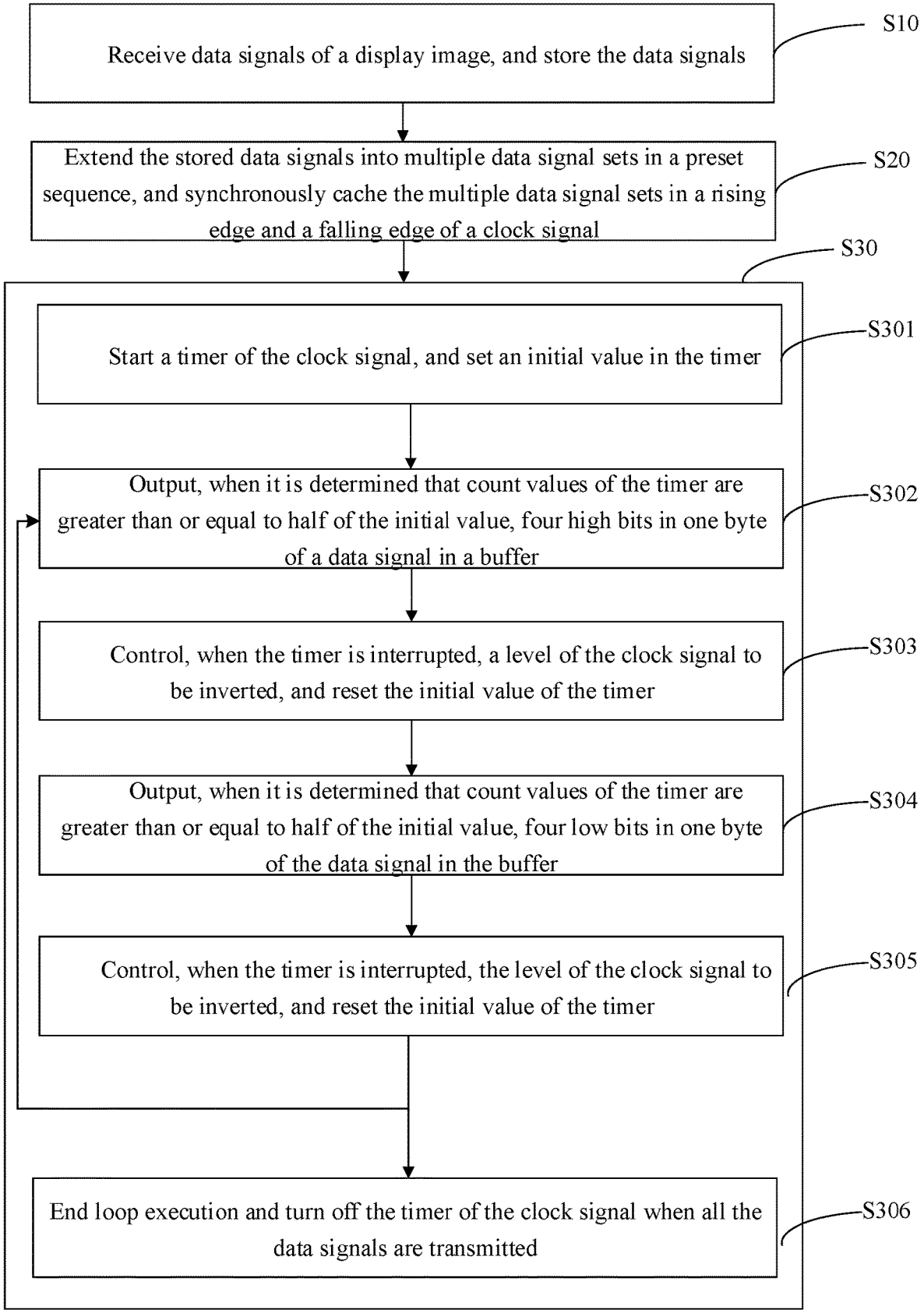
FIG. 7 is a flow diagram of the data display method according to one embodiment of the disclosure.

More specifically, referring to FIG. 7, in some embodiments, S30 further comprises:

S301: starting the timer CLK1 of the clock signal CLK, and setting the initial value K in the timer CLK1;

Repeating, wherein the data signal has not been transmitted, performing the following steps:

S302: outputting, when it is determined that count values of the timer CLK1 are greater than or equal to half of the initial value K, four high bits of one byte in a data signal in a buffer;

S303: when the timer CLK1 is interrupted, controlling the level of the clock signal CLK to be inverted, and resetting the initial value K of the timer CLK1;

S304: outputting, when it is determined that the count values of the timer CLK1 are greater than or equal to half of the initial value K, four low bits in one byte in the data signal in the buffer;

S305: when the timer CLK1 is interrupted, controlling the level of the clock signal CLK to be inverted, and resetting the initial value K of the timer CLK1;

S306: turning off the timer CLK1 of the clock signal CLK when the data signals SDA are transmitted.

Figure 8:
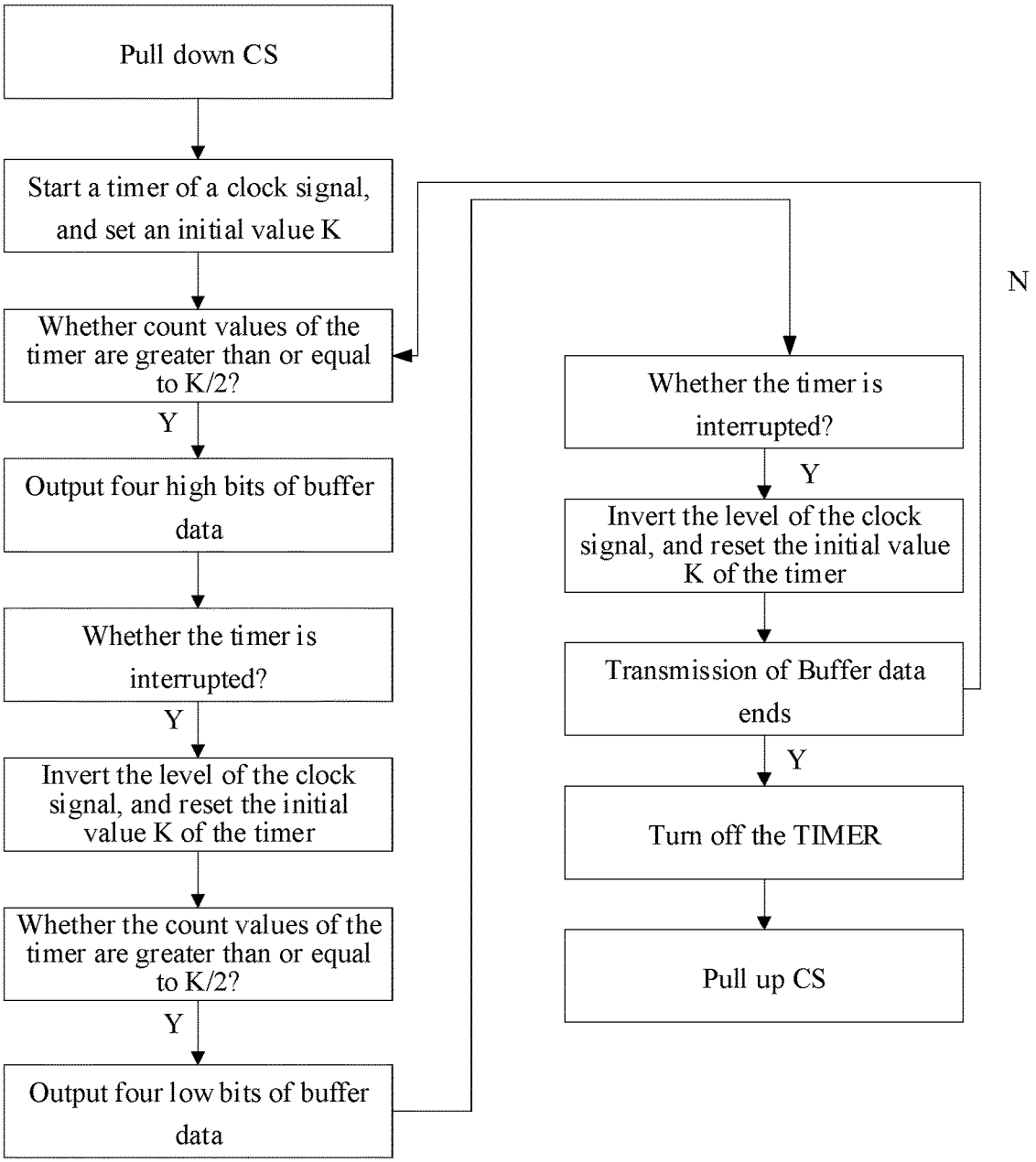
FIG. 8 is a flow diagram of the data display method according to one embodiment of the disclosure.

Specifically, referring to FIG. 8, the actual disclosure process is as follows: after the ARM system unit controls data or image data to be transmitted via image ports, the chip select signal CS is pulled down to enable the display unit to enter the data receiving state, the timer CLK1 of the clock signal CLK is started, the initial value K is set in the clock timer CLK1, and the frequency of the clock signal CLK may be adjusted by changing the parameter value of n, for example, K may be 1 μs; and then, when it is determined that the count values in the timer CLK1 are greater than or equal to K/2, four high bits of data in the buffer are output. For example, when the initial value is 1 μs, if the count values in the timer CLK1 are 1000, 500 count values in the 1000 count values represent data transmitted in the first 0.5 μs, and such data may be data in a high-level area corresponding to the clock signal. That is to say, when the ARM system unit determines that the count values in the timer CLK1 are greater than or equal to K/2, the four high bits in one byte of the data in the buffer are output, such as Data1, Data2, Data3 and Data4 (as shown in FIG. 4).

The other 500 count values represent data transmitted to the next 0.5 μs, and such data may be data in a low-level area corresponding to the clock signal. When the timer CLK1 is interrupted, the level of the clock signal CLK is inverted, and the initial value K of the timer is reset; when it is determined that the count values of the timer CLK1 are greater than or equal to K/2, four low bits of one byte of data in the buffer are output, such as Data5, Data6, Data7 and Data8. In this way, the transmission of one byte in the buffer is completed. Then, the level of the clock signal CLK is inverted again when the timer CLK1 is interrupted, the initial value K of the timer is reset again. By analogue, the data transmission process is repeated until all the data signals are transmitted, and the image data in the buffer is periodically transmitted, that is, the data signal transmission process is performed periodically. Finally, the timer CLK1 of the clock signal CLK is turned off when all the image data is transmitted, and the chip select signal CS is pulled up.

In some embodiments, the timing frequency of the timer depends on the initial value K. Wherein, the timing frequency T=1/K. It can be understood that the initial value K is a preset clock time, the reciprocal of time is frequency, so the timing frequency of the timer may be determined by the initial value K. For example, when K is 1 μs, the timing frequency is 1/1 μs=1000000 Hz=1 MHz.

Figure 9:
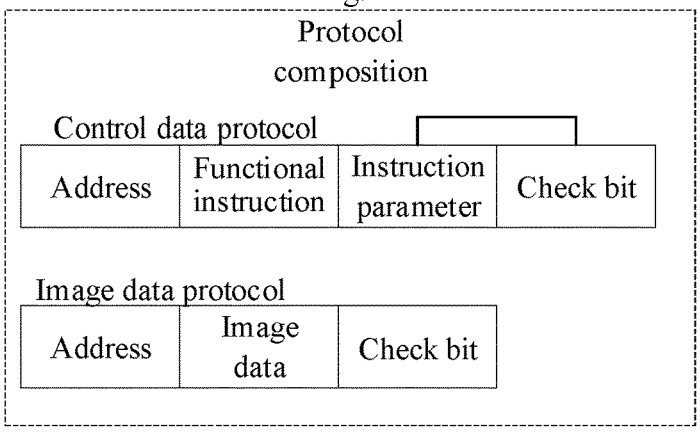
FIG. 9 is a schematic diagram of protocol composition of a data display method according to one embodiment of the disclosure.

In some embodiments, the data display method further comprises transmitting the multiple data signal sets by means of an image interface protocol to control the display unit to display the image, wherein the image interface protocol includes a control data protocol and an image data protocol. Specifically, referring to FIG. 9, the control data protocol may include: address, functional instruction, instruction parameter and check bit. At least one of the parameters, such as the resolution and the display brightness, of the display unit is controlled according to the control data protocol to realize the functional configuration of the display unit. The image data protocol may include address, image data and check bit. The display unit may control the image to be displayed according to the image data protocol.

Figure 10:
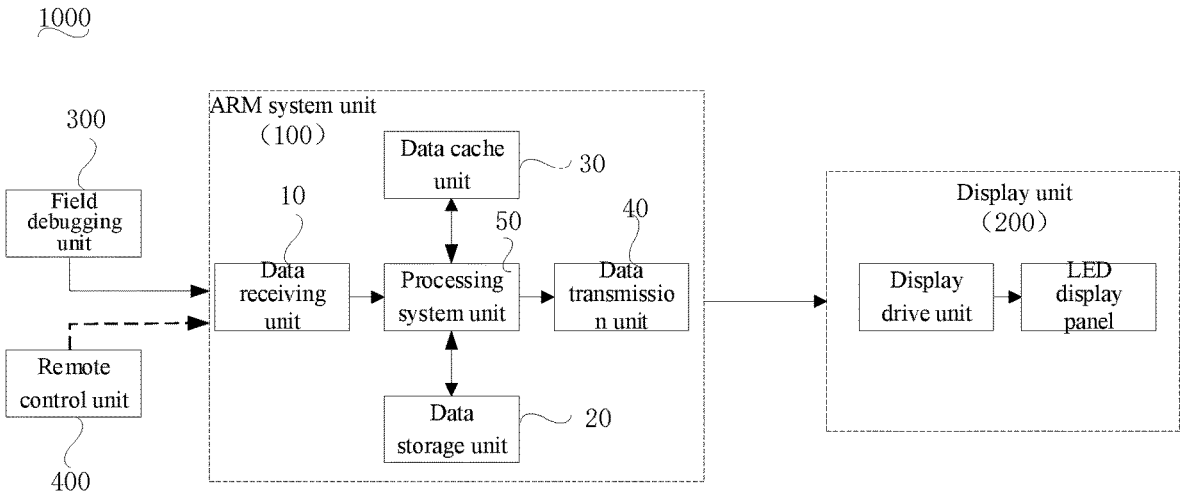
FIG. 10 is a structural diagram of a data display device according to one embodiment of the disclosure.

Referring to FIG. 10, the disclosure further provides a data display device 1000 based on an ARM micro-controller. The data display device 1000 comprises: an ARM system unit 100 and a display unit 200. Wherein, the ARM system unit 100 comprises a data receiving unit 10, a data storage unit 20, a data cache unit 30, a data transmission unit 40 and a processing system unit 50, wherein the data cache unit 30 may be the buffer mentioned above.

S10 may be implemented by the data receiving unit 10, the data storage unit 20 and the processing system unit 50, S20 may be implemented by the data cache unit 30 and the processing system unit 50, and S30 may be implemented by the data transmission unit 40 and the processing system unit 50. That is, the processing system unit 50 is used for controlling the data receiving unit 10 to receive data signals of a display image, controlling the data storage unit 20 to store the data signals, controlling the data cache unit 30 to extend the stored data signals into multiple data signal sets in a preset sequence and synchronously cache the multiple data signal sets in a rising edge and a falling edge of a clock signal, controlling the data transmission unit 40 to output the multiple data signal sets to multiple output ports respectively to control the display unit 200 to display the image. In this embodiment of the disclosure, the processing system unit 50 is an ARM micro-controller.

Figure 11:
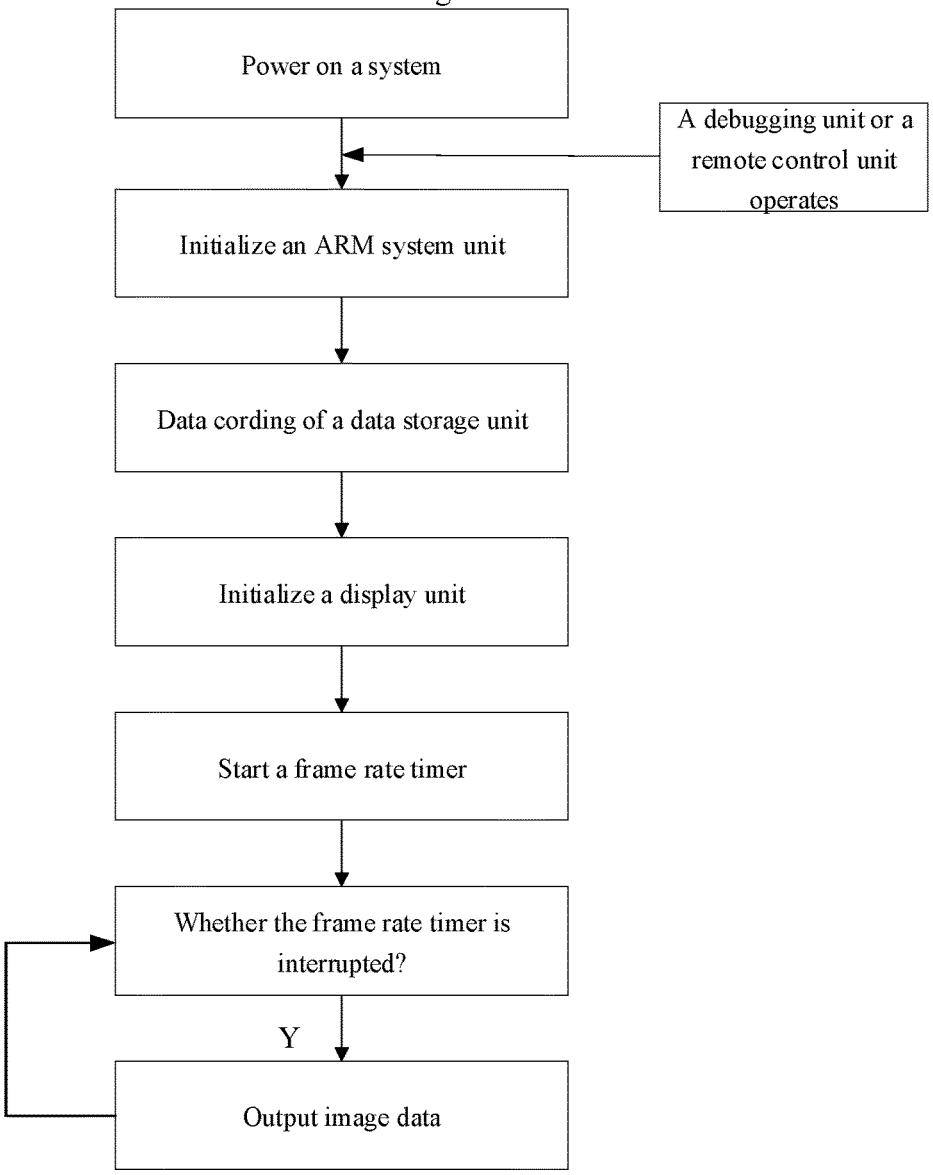
FIG. 11 is a flow diagram of the data display method according to one embodiment of the disclosure.

Specifically, referring to FIG. 11, in the actual data display process, after the data display device 1000 is powered on, the ARM micro-controller (the processing system unit 50) performs initial configuration on the system clock, hardware ports and functional modules in the ARM system unit 100; data stored in the data storage unit 20 is recoded by the ARM system unit 100 and is stored in the data cache unit 30 to meet transmission requirements of image ports; next, the ARM system unit 100 calls the recoded image data and initializes the display unit 200 by means of image ports PORTx, for example, the ARM system unit 100 controls the display parameters, such as the resolution, the refresh rate and the display brightness, of the display unit 200 to be initialized; then, a frame rate timer of the ARM micro-controller is started; when the frame rate timer is interrupted, the ARM system unit 100 starts to transmit image data to the display unit 200; and after the image data is transmitted, the ARM system unit enters a wait state. In this way, the ARM system unit 100 is able to transmit images data periodically at a fixed frequency.

The display unit 200 comprises a drive unit 210 and an LED display panel 220. The drive unit 210 is used for driving the display unit 200 to start to receive data signals (Data) and display an image according to the data signals. The LED display panel is used for displaying the image.

In some embodiments, the data display device 1000 further comprises display device ports respectively corresponding to multiple display blocks (Block (n+1)), and the multiple display blocks (Block (n+1)) are used for displaying an image according to multiple corresponding data signal sets.

Referring to FIG. 10 again, the data display device 1000 further comprises a field debugging unit 300 and a remote-control unit 400, wherein the field debugging unit 300 is used for debugging the configuration of the display device and may be programming software, and the configuration of the display device is debugged by means of a program in the programming software; and the remote-control unit 400 is used for wirelessly controlling remote on-off and function switching of the ARM system unit and the display unit.

The above-described device embodiments are merely illustrative, wherein the units that are described as separate components may or may not be physically separate, and the components that are displayed as units may or may not be physical units; in other words, they may be located at the same one location, and may also be distributed to a plurality of network units. Part or all of the modules may be selected according to the actual demands to realize the purposes of the solutions of the embodiments. A person skilled in the art can understand and implement the technical solutions without paying creative work.

Each component embodiment of the present disclosure may be implemented by hardware, or by software modules that are operated on one or more processors, or by a combination thereof. A person skilled in the art should understand that some or all of the functions of some or all of the components of the electronic device according to the embodiments of the present disclosure may be implemented by using a microprocessor or a digital signal processor (DSP) in practice. The present disclosure may also be implemented as apparatus or device programs (for example, computer programs and computer program products) for implementing part of or the whole of the method described herein. Such programs for implementing the present disclosure may be stored in a computer-readable medium, or may be in the form of one or more signals. Such signals may be downloaded from an Internet website, or provided on a carrier signal, or provided in any other forms.

Figure 12:
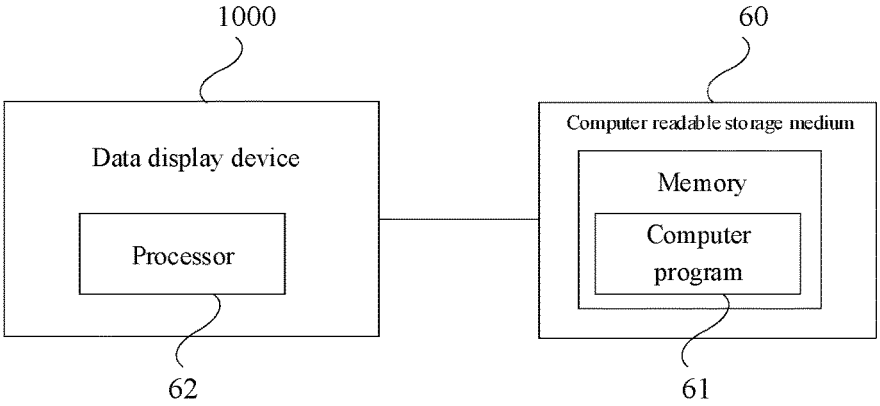
FIG. 12 is a structural diagram of a computer readable storage medium according to one embodiment of the disclosure.

Referring to FIG. 12, the disclosure further provides a non-volatile computer readable storage medium 60 of a computer program, wherein a computer program 61 is stored in the non-volatile computer readable storage medium 60.

When the computer program 61 is executed by one or more processors 62, the steps of the data display method in any one embodiment mentioned above are performed.

For example, when the program is executed by the processor 62, the following steps of the method are performed:

S10: receiving data signals of a display image, and storing the data signals;

S20: extending the stored data signals into multiple data signal sets in a preset sequence, and synchronously caching the multiple data signal sets in a rising edge and a falling edge of a clock signal; and S30: controlling the multiple data signal sets to be respectively output to multiple output ports to control a display unit to display the image.

The non-volatile computer readable storage medium 60 may be disposed in the processor 62 or a data source reader, and in this case, the processor 62 or the data source reader is able to communicate with a cloud server to obtain the corresponding computer program 61.

It can be understood that the computer program 61 comprises a computer program code.

The computer program code may be in the form of a source code, an object code or an executable file or some intermediate forms. The computer readable storage medium may comprise: any entities or devices capable of carrying the computer program code, a record medium, a USB flash disk, a mobile hard disk, a diskette, an optical disk, a computer memory, a read-only memory (ROM), a random access memory (RAM), a software distribution medium, or the like.

Figure 13:
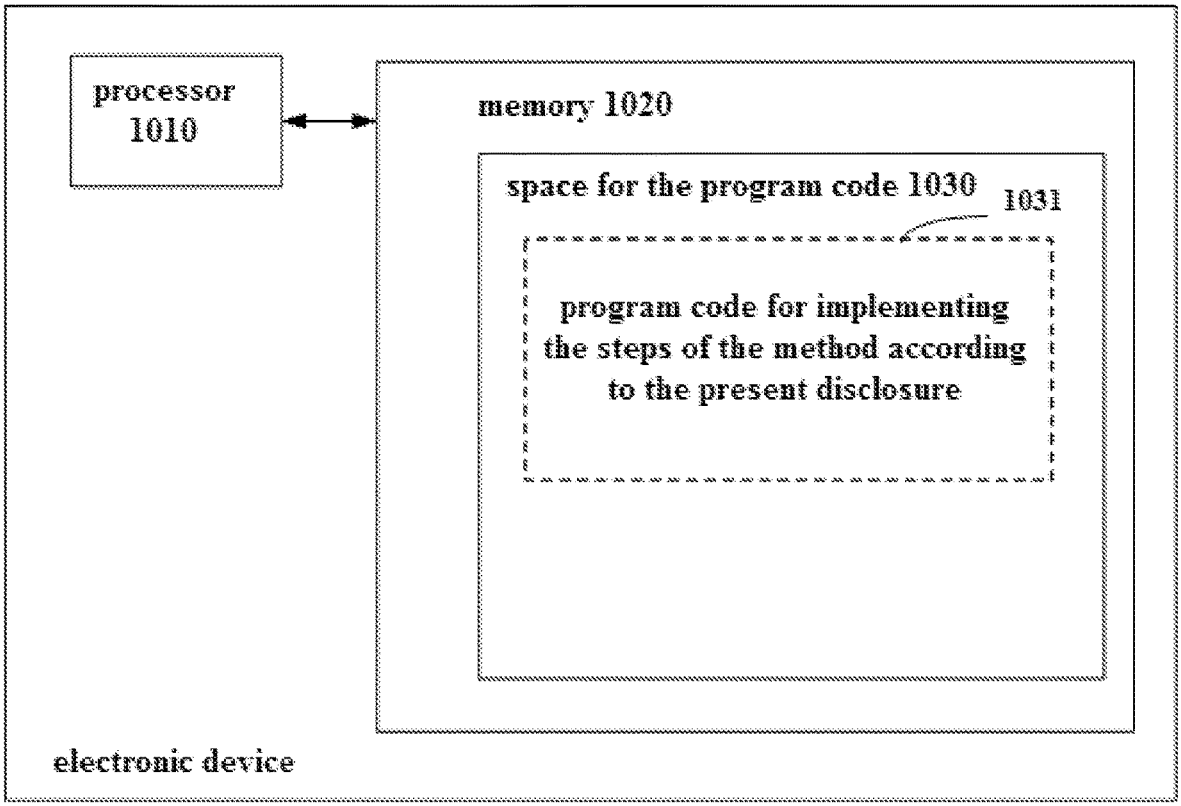
FIG. 13 schematically shows a block diagram of an electronic device for implementing the method according to the present disclosure.
Figure 14:
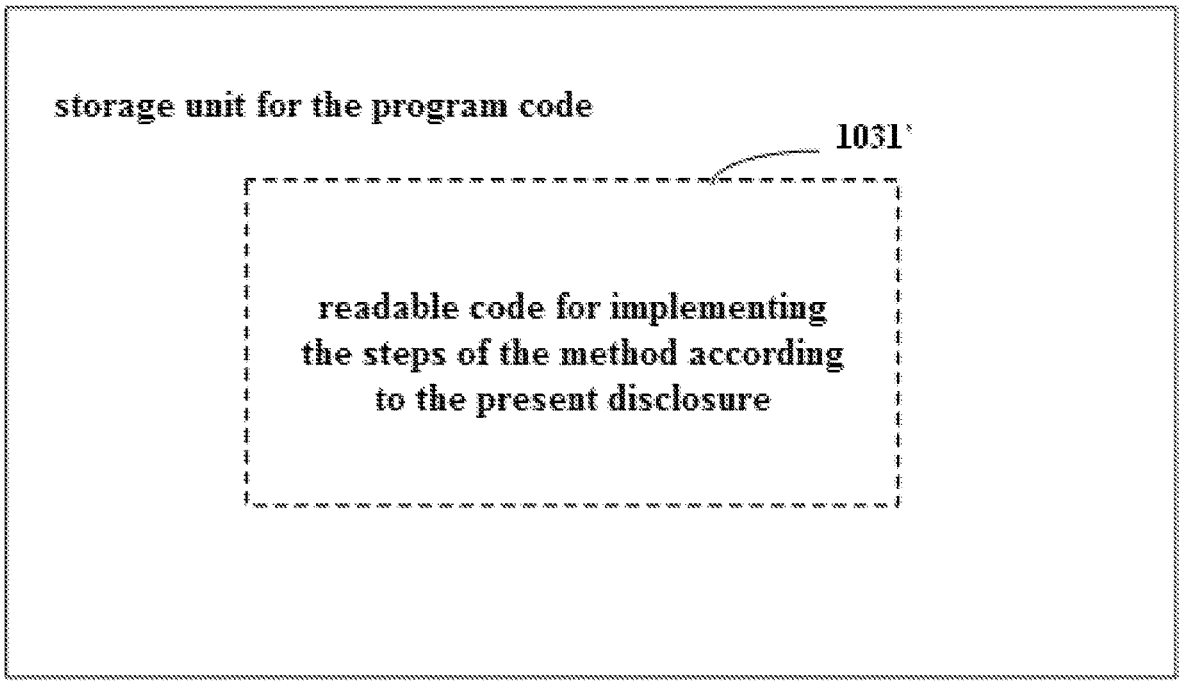
FIG. 14 schematically shows a storage unit for maintaining or carrying a program code for implementing the method according to the present disclosure.

For example, FIG. 13 shows an electronic device that can implement the method according to the present disclosure. The electronic device traditionally comprises a processor 1010 and a computer program product or computer-readable medium in the form of a memory 1020. The memory 1020 may be electronic memories such as flash memory, EEPROM (Electrically Erasable Programmable Read Only Memory), EPROM, hard disk or ROM. The memory 1020 has the storage space 1030 of the program code 1031 for implementing any steps of the above method. For example, the storage space 1030 for program code may contain program codes 1031 for individually implementing each of the steps of the above method. Those program codes may be read from one or more computer program products or be written into the one or more computer program products. Those computer program products include program code carriers such as a hard disk, a compact disk (CD), a memory card or a floppy disk. Such computer program products are usually portable or fixed storage units as shown in FIG. 12. The storage unit may have storage segments or storage spaces with similar arrangement to the memory 1020 of the electronic device in FIG. 11. The program codes may, for example, be compressed in a suitable form. Generally, the storage unit contains a computer-readable code 1031', which can be read by a processor 1010. When those codes are executed by the electronic device, the codes cause the electronic device to implement each of the steps of the method described above.

In the description of this specification, the statement of reference terms such as "one embodiment", "some embodiments", "illustrative embodiment", "example", "specific example", is intended to indicate that specific features, structures, materials or characteristics described in conjunction with said embodiment or example are included in at least one embodiment or example of the disclosure. In this specification, illustrative statements of these terms do not definitely direct at the same embodiment or example. In addition, the specific features, structures, materials or characteristics may be combined in any one or more embodiments or examples in any appropriate manners.

Although the embodiments of the disclosure have been illustrated and described above, those ordinarily skilled in the art would appreciate that different variations, modifications, substations and transformations can be made to these embodiments without departing from the principle and concept of the disclosure, and the scope of the disclosure should be defined by the claims and their equivalents.

The invention claimed is:

1. A data display method based on an ARM microcontroller, being applied to a mini-LED display device, wherein the data display method comprises:

receiving data signals of a display image, and storing the data signals;

extending stored data signals into multiple data signal sets in a preset sequence, and synchronously caching the multiple data signal sets in a rising edge and a falling edge of a clock signal; and controlling the multiple data signal sets to be respectively output to multiple output ports to control a display unit to display an image;

wherein the step of controlling the multiple data signal sets to be respectively output to the multiple output ports to control a display unit to display the image comprises:

starting a timer of the clock signal, and setting an initial value in the timer;

repeating, wherein a data signal has not been transmitted, performing the following steps:

outputting, when it is determined that count values of the timer are greater than or equal to half of the initial value, four high bits in one byte of a data signal in a buffer;

controlling, when the timer is interrupted, a level of the clock signal to be inverted, and resetting the initial value of the timer;

outputting, when it is determined that count values of the timer are greater than or equal to half of the initial value, four low bits in one byte of the data signal in the buffer;

controlling, when the timer is interrupted, the level of the clock signal to be inverted, and resetting the initial value of the timer; and repeating a data signal transmission process until all data signals are transmitted, and periodically performing the data signal transmission process; and end repeating, turning off the timer of the clock signal when the data signal has been transmitted.

2. The data display method according to claim 1, further comprising: acquiring a chip select signal.

3. The data display method according to claim 1, wherein, the step of extending the stored data signals into multiple data signal sets in a preset sequence, and synchronously caching the multiple data signal sets in a rising edge and a falling edge of a clock signal comprises:

controlling, when a chip select signal is pulled down and the clock signal outputs a signal at a preset clock time, the data signals in the multiple data signal sets to be cached in the rising edge and the falling edge of the clock signal.

4. The data display method according to claim 1, wherein the multiple output ports correspond to multiple display blocks of the display unit, and the step of controlling the multiple data signal sets to be respectively output to the multiple output ports to control a display unit to display the image comprises:

correspondingly transmitting the multiple data signal sets to the multiple display blocks.

5. The data display method according to claim 1, wherein a timing frequency of the timer depends on the initial value.

6. The data display method according to claim 1, further comprising:

transmitting the multiple data signal sets via an image interface protocol to control the display unit to display the image, wherein the image interface protocol includes a control data protocol and an image data protocol.

7. The data display method according to claim 6, further comprising:

controlling at least one of resolution, refresh rate and display brightness of the display unit according to the control data protocol.

8. The data display method according to claim 6, further comprising:

controlling the image to be displayed according to the image data protocol.

9. The data display method according to claim 6, wherein the control data protocol may include: address, functional instruction, instruction parameter and check bit, the image data protocol may include: address, image data and check bit.

10. An electronic device, wherein the electronic device comprises:

a memory configured for storing a computer instruction executable by a processor; and one or more processors configured for executing the computer instruction, to implement the data display method according to claim 1.

11. A data display device based on an ARM micro-controller, comprising:

an ARM system unit and a display unit, wherein the ARM system unit comprises a data receiving unit, a processing system unit, a data cache unit, a data storage unit and a data transmission unit; the processing system unit is used for:

controlling the data receiving unit to receive data signals of a display image, and controlling the data storage unit to store the data signals;

controlling the data cache unit to extend stored data signals into multiple data signal sets in a preset sequence and synchronously cache the multiple data signal sets in a rising edge and a falling edge of a clock signal; and controlling the data transmission unit to output the multiple data signal sets to multiple output ports respectively to control the display unit to display an image;

wherein the operation of controlling the data transmission unit to output the multiple data signal sets to multiple output ports respectively to control the display unit to display an image comprises:

starting a timer of the clock signal, and setting an initial value in the timer;

repeating, wherein a data signal has not been transmitted, performing the following steps:

outputting, when it is determined that count values of the timer are greater than or equal to half of the initial value, four high bits in one byte of a data signal in a buffer;

controlling, when the timer is interrupted, a level of the clock signal to be inverted, and resetting the initial value of the timer;

outputting, when it is determined that count values of the timer are greater than or equal to half of the initial value, four low bits in one byte of the data signal in the buffer;

controlling, when the timer is interrupted, the level of the clock signal to be inverted, and resetting the initial value of the timer; and repeating a data signal transmission process until all data signals are transmitted, and periodically performing the data signal transmission process; and end repeating, turning off the timer of the clock signal when the data signal has been transmitted.

12. The data display device according to claim 11, wherein the display unit comprises a drive unit and an LED display panel.

13. The data display device according to claim 12, wherein the drive unit is used for driving the display unit to start to receive data signals and display an image according to the data signals, the LED display panel is used for displaying the image.

14. The data display device according to claim 11, further comprising display device ports respectively corresponding to multiple display blocks, and the multiple display blocks are used for displaying the image according to the multiple data signal sets.

* * * * *